US012006782B2

(12) United States Patent
Alamer et al.

(10) Patent No.: US 12,006,782 B2
(45) Date of Patent: Jun. 11, 2024

(54) WELLHEAD SIDE-OUTLET CONTINGENCY VR PLUG INTEGRAL ADAPTOR

(71) Applicant: Saudi Arabian Oil Company, Dhahran (SA)

(72) Inventors: Mansour Abdullah Alamer, Dammam (SA); Mohammed Eid Almukhlifi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 135 days.

(21) Appl. No.: 17/874,376

(22) Filed: Jul. 27, 2022

(65) Prior Publication Data

US 2024/0035350 A1 Feb. 1, 2024

(51) Int. Cl.
*E21B 33/068* (2006.01)

(52) U.S. Cl.
CPC ..... *E21B 33/068* (2013.01)

(58) Field of Classification Search
CPC ..... E21B 33/068
See application file for complete search history.

(56) References Cited

U.S. PATENT DOCUMENTS

| | | | | |
|---|---|---|---|---|
| 6,186,239 | B1 | 2/2001 | Monjure et al. | |
| 8,181,700 | B2 | 5/2012 | Baugh | |
| 10,502,021 | B2 | 12/2019 | Healy | |
| 2017/0044861 | A1* | 2/2017 | Guedes | E21B 34/02 |
| 2018/0179854 | A1* | 6/2018 | Healy | E21B 47/00 |
| 2022/0170343 | A1* | 6/2022 | Brodie | E21B 34/02 |

* cited by examiner

*Primary Examiner* — Giovanna Wright
(74) *Attorney, Agent, or Firm* — Dinsmore & Shohl LLP

(57) ABSTRACT

A contingency adaptor for a wellhead side-outlet with a damaged valve removal plug profile. The adaptor includes a neck on one end which may be extended into the wellhead side-outlet for creating a fluid seal between the neck and an inner surface of the wellhead side-outlet. A flange at the one end is configured to receive a gasket for creating a separate fluid seal between the adaptor and an outer surface of the wellhead side-outlet. The adaptor includes a valve removal plug profile at an opposite end to accommodate installation of a valve removal plug. The adaptor also includes a test port for pressure testing the connection between the adaptor and the wellhead side-outlet in order to confirm the integrity of the fluid seal(s) formed there between.

20 Claims, 6 Drawing Sheets

WELLHEAD SIDE-OUTLET CONTINGENCY VR PLUG INTEGRAL ADAPTOR

FIELD OF THE INVENTION

This disclosure relates to an adaptor for a wellhead side-outlet. More specifically, it relates to an integral contingency adaptor as a solution for a wellhead side-outlet with a damaged valve removal plug profile.

BACKGROUND OF THE INVENTION

The wellhead of a wellbore includes all permanent equipment between the uppermost portion of the surface casing and the tubing head adapter connection. A conventional surface wellhead configuration includes a casing head housing, casing head spool(s), a tubing head spool, a tubing bonnet, and a production tree, which are installed in stages during the drilling phase of a well. A key function of a wellhead is to suspend the casing load at the surface and seal the annuli between the large casings and the small casings. Additionally, wellhead spools contain side-outlets to facilitate the installation of gate valves and/or blind flanges, to monitor these annuli, and enable future interventions if required.

Wellhead side-outlets usually include a special threaded profile to accommodate for the installation of a valve removal (VR) plug. VR plugs provide a mechanical barrier to isolate the annulus pressure in order to, for example, safely replace a damaged gate valve. Losing this functionality compromises wellhead integrity and complicates intervention solutions. If the VR plug profile becomes damaged, critical operations are required to repair and re-machine the special threaded profile, thus necessarily involving a heat source near a hazardous zone. Accordingly, a damaged wellhead side-outlet typically requires complex and high-risk operations in order to safely repair it.

Previous attempts at developing solutions to deal with leaking wellhead side-outlets involve depleting pressure from the leaking VR plug based on the often incorrect assumptions that the installation of the VR plug was improper and that the VR plug profile of the wellhead remains in good condition. Alternative efforts involve utilizing a complex system to safely displace fluid/pressure from the annulus, which requires careful planning to be implemented successfully.

Accordingly, a need exists for a solution that minimizes the risks associated with conducting a field repair in the event a VR plug profile of a wellhead side-outlet is damaged. In particular, there exists a need for an apparatus that functions as a contingency adaptor for a wellhead side-outlet with a damaged VR plug profile. Moreover, an apparatus fulfilling this need should permit an installation process that is simple and follows standard API flange make-up processes, and should also accommodate pressure testing the connection between the apparatus and the wellhead spool containing the wellhead side-outlet.

SUMMARY OF THE INVENTION

The present disclosure describes a new apparatus configured as a contingency adaptor for a wellhead side-outlet with a damaged VR plug profile. The adaptor may be coupled to the wellhead side-outlet following a standard API flange make-up process, thereby creating a first fluid seal between a flange of the adaptor and an outer surface of the wellhead side-outlet. The adaptor may comprise a neck which extends into the wellhead side-outlet containing the damaged VR plug profile, and a second fluid seal may be formed between the neck and the interior surface of the wellhead side-outlet. The adaptor may comprise a test port that allows for pressure testing the connection between the adaptor and the wellhead side-outlet with the damaged VR plug profile. The outer side of the adaptor may be coupled to other wellhead side-outlet components and may comprise an adaptor VR plug profile to facilitate future side-outlet valve replacement.

In accordance with one embodiment of the present disclosure, an apparatus configured as a contingency adaptor for a wellhead side-outlet of a well head component includes an outer side comprising an first flange and a valve removal (VR) plug profile configured to accommodate installation of a VR plug; an inner side opposite the outer side, the inner side comprising a second flange and a neck; and a test port. The second flange is configured to be coupled to the wellhead side-outlet and to receive a gasket for creating a first fluid seal between the second flange and an outer surface of the wellhead side-outlet. The neck is configured to receive a seal around an outer diameter of the neck for creating a second fluid seal between an outer surface of the neck and an inner surface of the wellhead side-outlet. The test port is configured to accommodate pressure testing a volume defined by the apparatus, the wellhead component, the seal, and the gasket.

In accordance with another embodiment of the present disclosure, the apparatus comprises a single, unitary structure. The gasket may be a ring gasket and the second flange may comprise a ring groove for receiving the ring gasket. The seal may comprise an elastomeric material. The second flange may comprise a plurality of openings for receiving a plurality of fasteners for coupling the second flange to the wellhead side-outlet. The first flange may be configured to be coupled to another wellhead side-outlet component. The wellhead component containing the wellhead side-outlet may be a casing head housing, a casing head spool, or tubing head adaptor. The neck may be further configured to receive at least one additional seal around the outer diameter of the neck for creating at least one additional second fluid seal between the outer surface of the neck and the inner surface of the wellhead side-outlet. The VR plug profile may comprise a machine threaded interior surface. The neck of the apparatus may extend beyond the second flange.

In accordance with another embodiment of the present disclosure, a method of adapting a wellhead side-outlet of a wellhead component to accommodate the installation of a VR plug includes: (i) providing an apparatus configured as a contingency adaptor for the wellhead side-outlet, the apparatus comprising: an outer side comprising a first flange and a VR plug profile configured to accommodate installation of the VR plug; an inner side opposite the outer side, the inner side comprising a second flange and a neck; and a test port; (ii) coupling the apparatus to the wellhead side-outlet, wherein coupling the apparatus to the wellhead side-outlet comprises: (a) positioning the neck within the wellhead side-outlet such that an outer surface of the neck faces an inner surface of the wellhead side-outlet; (b) creating, with a gasket, a first fluid seal between the second flange and an outer surface of the wellhead side-outlet; and (c) creating, with a seal placed around an outer diameter of the neck, a second fluid seal between the outer surface of the neck and the inner surface of the wellhead side-outlet; and (iii) pressure testing, via the test port, a volume defined by the apparatus, the wellhead component, the seal, and the gasket.

In accordance with another embodiment of the present disclosure, prior to coupling the apparatus to the wellhead side-outlet, the method may comprise polishing a damaged valve removal profile of the wellhead side-outlet to provide a sealing surface. The method may further comprise creating, with at least one additional seal, at least one additional second fluid seal between the outer surface of the neck and the inner surface of the wellhead side-outlet. The method may further comprise coupling the first flange to another wellhead side-outlet component.

In accordance with another embodiment of the present disclosure, coupling the apparatus to the wellhead side-outlet further may comprise coupling the second flange to the wellhead side-outlet following a standard API flange make-up process.

Although the concepts of the present disclosure are described herein with primary reference to the use of the contingency adaptor on a wellhead side-outlet of a casing head spool, it is contemplated that the concepts will enjoy applicability to a wellhead side-outlet of any wellhead component. For example, and not by way of limitation, it is contemplated that the concepts of the present disclosure will enjoy applicability to wellhead side-outlets of casing head spools and tubing head adaptors.

BRIEF DESCRIPTION OF THE DRAWINGS

The following detailed description of specific embodiments of the present disclosure can be best understood when read in conjunction with the following drawings, where like structure is indicated with like reference numerals and in which.

DETAILED DESCRIPTION OF THE INVENTION

The present disclosure describes a new apparatus configured as a contingency adaptor for a wellhead side-outlet with a damaged VR plug profile. The adaptor may be coupled to the wellhead side-outlet following a standard API flange make-up process, thereby creating a first fluid seal between a flange of the adaptor and an outer surface of the wellhead side-outlet. The adaptor may comprise a neck which extends into the wellhead side-outlet containing the damaged VR plug profile, and a second fluid seal may be formed between the neck and the interior surface of the wellhead side-outlet. The adaptor may comprise a test port that allows for pressure testing the connection between the adaptor and the wellhead side-outlet with the damaged VR plug profile. The outer side of the adaptor may be coupled to other wellhead side-outlet components and may comprise an adaptor VR plug profile to facilitate future side-outlet valve replacement.

Figure 1:
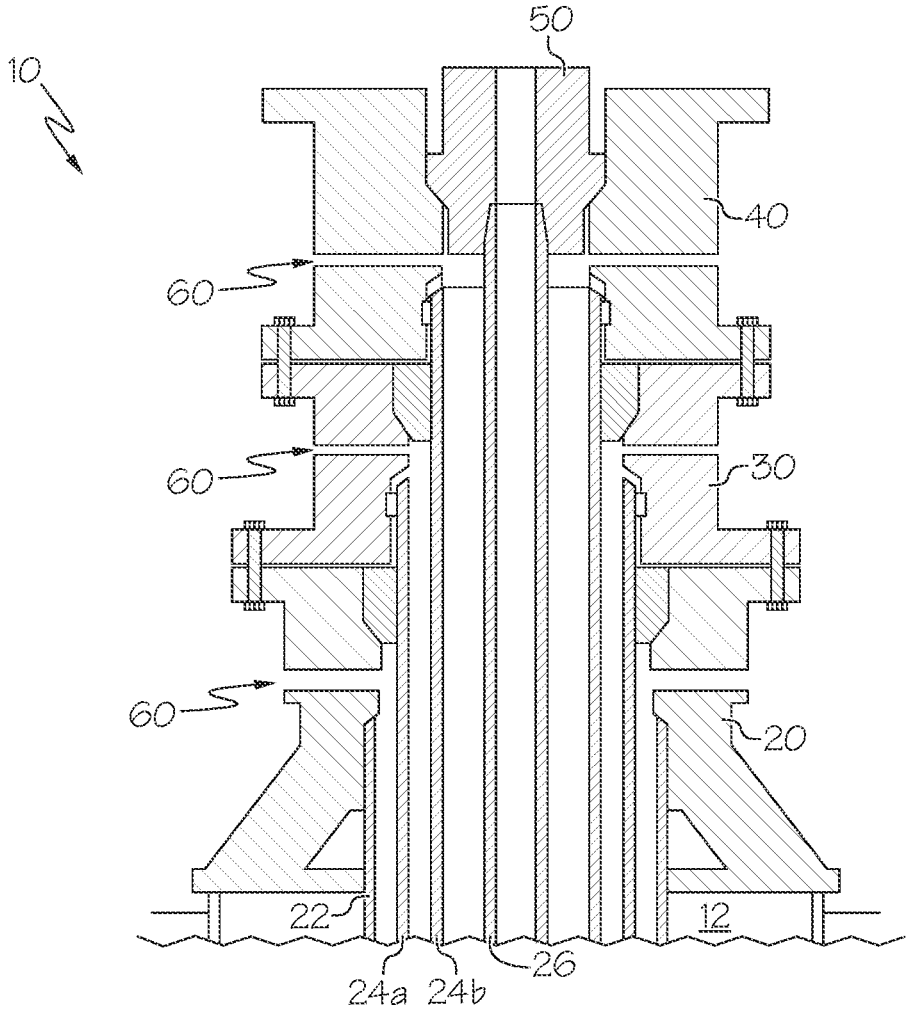
FIG. 1 illustrates an exemplary wellhead assembly.

Referring initially to FIG. 1, a high-level schematic of a wellhead assembly 10 is shown. The wellhead assembly 10 is positioned above a wellhead hub 12 and coupled with a mineral deposit or reservoir via a wellbore which extends downwards from the wellhead hub 12. The wellhead assembly 10 may comprise a casing head housing 20, a casing head spool 30, and a tubing head spool 40. Surface casing 22 extends from the wellbore through the wellhead hub 12 and into the wellhead assembly 10 where it is suspended by the casing head housing 20. The casing head housing 20 seals the annular space between the surface casing 22 and an outer intermediate casing 24*a*. The outer intermediate casing 24*a* is run inside surface casing 22 and extends from the wellbore through the wellhead hub 12 and into the wellhead assembly 10, where it is suspended by the casing head spool 30. The casing head spool 30 is attached to the casing head housing 20 and seals the annular space between the outer intermediate casing 24*a* and an inner intermediate casing 24*b*. The inner intermediate casing 24*b* is run inside the outer intermediate casing 24*a* and extends from the wellbore through the wellhead hub 12 and into the wellhead assembly 10, where it is suspended by the tubing head spool 40. The tubing head spool is attached to the casing head spool 30 and a tubing hanger 50 within the tubing head spool 40 seals the annular space between the inner intermediate casing 24*b* and production tubing 26. The production tubing 26 is run inside the inner intermediate casing 24*b* and extends from the wellbore through the wellhead hub 12 and into the wellhead assembly 10, where it is attached to the tubing hanger 50 within the tubing head spool 40.

Wellhead components such as the casing head housing 20, the casing head spool 30, and/or the tubing head spool 40 may comprise wellhead side-outlets 60. Wellhead side-outlets allow access to the annuli between the casings and/or between the inner intermediate casing 24*b* and the production tubing 26. Wellhead side-outlets 60 facilitate the installation of gate valves and/or blind flanges to monitor these annuli and enable future interventions if required.

Figure 2:
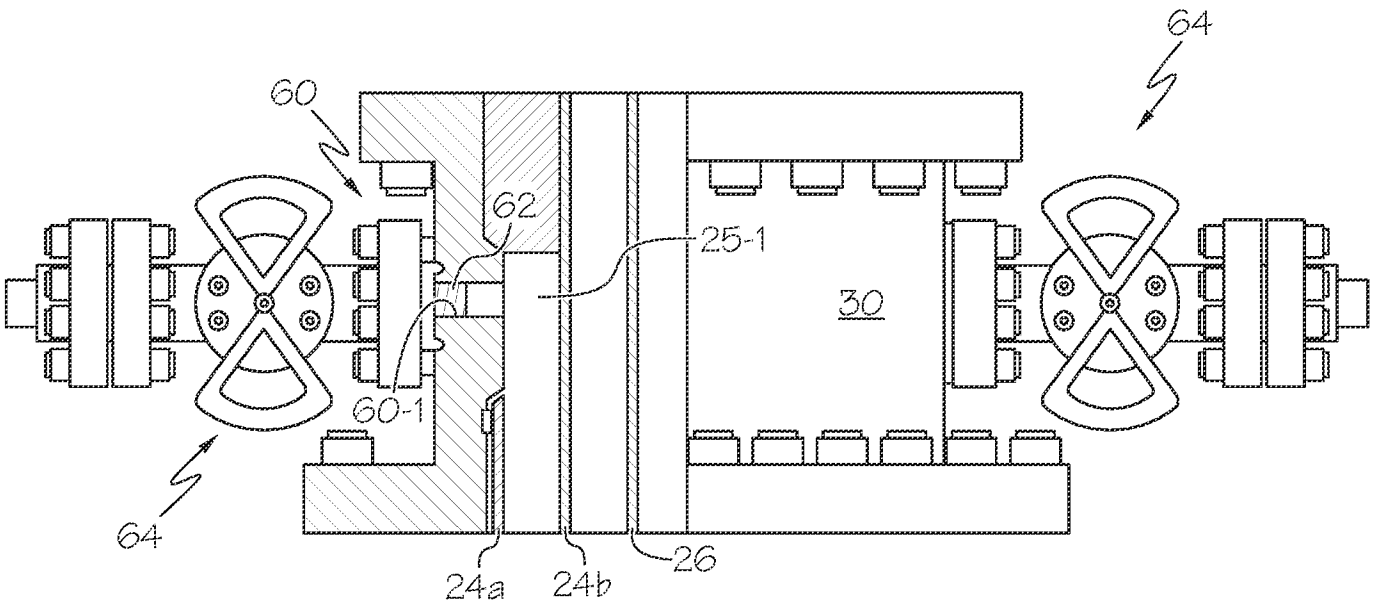
FIG. 2 illustrates an exemplary wellhead component containing a wellhead side-outlet with a gate valve attached thereto, wherein the left side of the wellhead component is shown partially cutaway.

Referring now to FIG. 2, wellhead side-outlets 60 usually include a special threaded profile, referred to as a VR plug profile 62, to accommodate for the installation of a VR plug. As mentioned above, VR plugs provide a mechanical barrier to isolate the annulus pressure in order to, for example, safely replace a damaged gate valve. The specifications of the plug and special threaded profile, also referred to as a "VR plug profile," are defined by the American Petroleum Institute (API) SPEC 6A standard.

With continued reference to FIG. 2, a schematic wellhead component, such as, for example, casing head spool 30, is shown with a gate valve 64 attached to each of two wellhead side-outlets 60. Moreover, the left side of the casing head spool 30 in FIG. 2 is shown partially cutaway to reveal the VR plug profile 62 that may be provided on an inner surface 60-1 of the wellhead side-outlet 60. The wellhead side-outlet 60 shown in FIG. 2 provides access to the annulus 25-1 between the outer intermediate casing 24*a* and the inner intermediate casing 24*b*.

Figure 3:
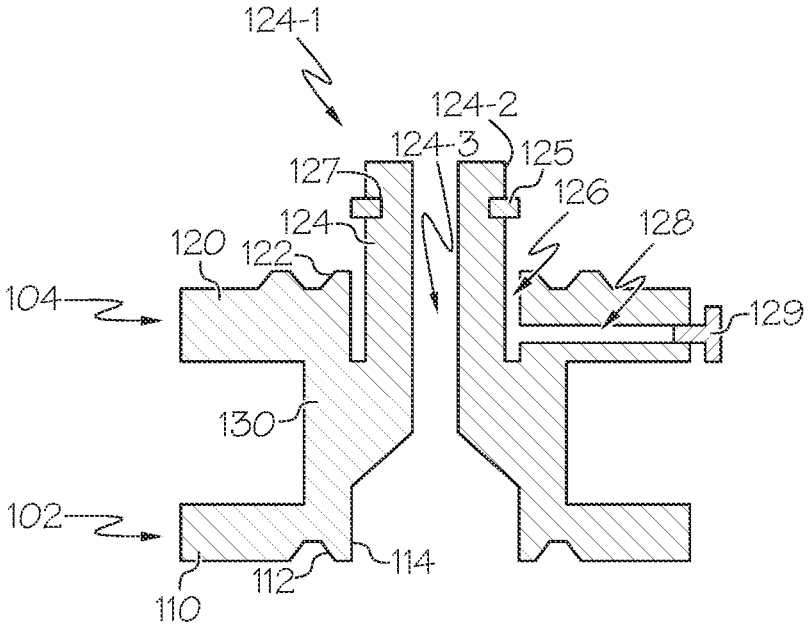
FIG. 3 illustrates an wellhead side-outlet contingency adaptor, according to one or more embodiments of the present disclosure.

Referring now to FIG. 3, a wellhead side-outlet contingency adaptor 100 is shown. The adaptor 100 may be of single, unitary structure. Alternatively, the adaptor 100 may comprise multiple components. The adaptor 100 may be made of alloy steel such as ASTM A182 F22, AISI 8630, or AISI 4130, as non-limiting examples.

The adaptor 100 includes an outer side 102 comprising a first flange 110, an inner side 104 comprising a second flange 120, and a body portion 130 connecting the first flange 110 and the second flange 120. In some embodiments, the first flange 110 and second flange 120 are in parallel planes. The adaptor 100 is configured to be coupled to a wellhead side-outlet 60. The outer side 102 refers to a side of the adaptor 100 which is further away from the wellhead side-outlet 60 when the adaptor 100 is coupled to the wellhead side-outlet 60 (see e.g., FIG. 4). The inner side 104 refers to the side of the adaptor 100 which is closer (than the outer side 102) to the wellhead side-outlet 60 when the adaptor 100 is coupled to the wellhead side-outlet 60 (see e.g., FIG. 4).

Figure 4:
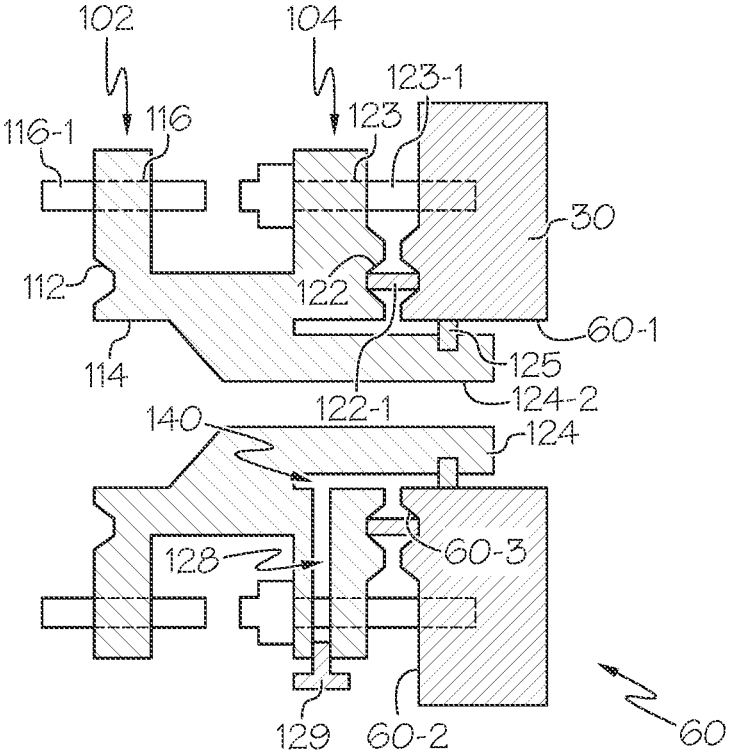
FIG. 4 illustrates a wellhead side-outlet contingency adaptor, according to one or more embodiments of the present disclosure, coupled to a wellhead side-outlet of a wellhead component.

With reference to FIGS. 3 and 4, the first flange 110 may comprise a groove 112 and a plurality of fastener openings 116. The groove 112 may be a ring groove. The groove 112 and plurality of fastener openings 116, e.g., a plurality of holes, of the first flange 110 may facilitate the formation of a flanged connection with another wellhead side-outlet component, such as a gate valve 64 or a blind flange (see e.g., FIG. 6). In some embodiments, a bolt 116-1 can be inserted through each of the plurality of fastener openings 116 such that the first flange 110 may be bolted to a flange of another wellhead side-outlet component thereby forming a flanged connection (see e.g., FIG. 6). The groove 112 may be configured to receive a gasket (not shown), e.g., a ring gasket, so as to enable a fluid seal to be formed between the first flange 110 and the flange of another wellhead side-outlet component.

The outer side 102 may further comprise an adaptor VR plug profile 114. The adaptor VR plug profile 114 may be a special threaded profile that matches the VR plug profile 62 of a wellhead side-outlet 60 to which the adaptor 100 is coupled. Accordingly, the adaptor VR plug profile 114 may accommodate for the installation of a VR plug 302 at the outer side 102 of the adaptor 100 (see e.g., FIG. 5D). The special threaded profile of the adaptor VR plug profile 114 may be defined by the American Petroleum Institute (API) SPEC 6A standard.

The second flange 120 may comprise a groove 122 and a plurality of fastener openings 123. The groove 122 may be a ring groove. The groove 122 and plurality of fastener openings 123, e.g., a plurality of holes, of the second flange 120 may facilitate the formation of a flanged connection with an outer surface 60-2 of a wellhead side-outlet 60. In some embodiments, a bolt 123-1 can be inserted through each of the plurality of fastener openings 123 such that the second flange 120 may be bolted to the outer surface 60-2 of a wellhead side-outlet 60 thereby forming a flanged connection. The groove 122 may receive a gasket 122-1, e.g., a ring gasket, so as to enable a fluid seal to be formed between the second flange 120 and the outer surface 60-2 of the wellhead side-outlet 60. The gasket 122-1 may be an API 6A metal ring gasket. The gasket 122-1 may create, when torque is applied to the connection, a metal to metal fluid seal with both the groove 122 of the second flange and a corresponding groove 60-3 on the outer surface 60-2 of the wellhead side-outlet 60.

The inner side 104 may further comprise a centrally disposed neck 124 and a slot 126 around the outer perimeter of a proximal portion 124-3 of the neck 124. The slot 126 may annular. In some embodiments, the neck 124 and slot 126 are coaxial centrally located with respect to the adaptor 100 when viewed in a direction normal to a plane of the second flange 120. The neck 124 may extend beyond the second flange 120 perpendicular to the plane of the second flange 120. The slot 126 may be configured such that the second flange 120 and/or the body portion 130 of the adaptor 100 forms a sleeve around the neck 124. A test port 128 may extend radially inwards through the second flange 120 or the body portion 130 and connect with a portion of the slot 126. The test port 128 in FIG. 3 is shown extending through the second flange 120. With the exception of the test port 128, the adaptor 100 may be symmetrical about a central axis (not shown). As will be discussed in more detail below, the test port 128 may be configured to accommodate pressure testing the connection between the adaptor 100 and the wellhead component (e.g., casing head spool 30) containing the wellhead side-outlet 60 to which the adaptor 100 is coupled. The test port 128 may comprise a ½" NPT bleeder fitting such as those manufactured by TECHNE or PASCAL INDUSTRIES.

A distal end 124-1 of the neck 124 may be configured to receive a seal 125 around an outer diameter of the neck 124 so as to permit the formation of a fluid seal between an outer surface 124-2 of the neck 124 and the inner surface 60-1 of the wellhead side-outlet 60. The seal 125 may be disposed in a groove 127 cut into the outer surface 124-2 of the neck 124. The seal 125 may be an elastomeric material such as a CAMLAST seal or a seal comprising hydrogenated acrylonitrile-butadiene rubber (HNBR), as non-limiting examples. In the context of the present disclosure, "seal," when used as a noun without "fluid" preceding it, refers to a product, e.g., a molded or machined part. "Fluid seal," in the context of the present disclosure, refers to the functional effect of preventing the passage of fluids.

The test port 128 is shown in FIG. 3 with a pressure boundary fitting 129 installed thereon. The pressure boundary fitting 129 is a standard one-way check valve that provides access to an internal wellhead cavity for conducting a pressure test or monitoring for an internal pressure leak. In this case, the internal wellhead cavity would be the volume 140 (see FIG. 4) defined by the adaptor 100, the wellhead component comprising the wellhead side-outlet 60 to which the adaptor 100 is coupled, the seal 125 between the neck 124 and the inner surface 60-1 of the wellhead side outlet, and the gasket 122-1 between the second flange 120 and the outer surface 60-2 of the wellhead side-outlet 60. With the exception of the test port 128, the volume 140 may be symmetrical about the common central axis (not shown) of the adaptor 100.

The neck 124 of the adaptor 100 may be further configured to receive at least one additional seal (not shown) around the outer diameter of the neck 124 for creating at least one additional second fluid seal between the outer surface 124-2 of the neck 124 and the inner surface 60-1 of the wellhead side-outlet 60.

With reference to FIGS. 5A-5D and FIG. 7, a method 400 of adapting a wellhead side-outlet of a wellhead component to accommodate the installation of a VR plug is now described. The method 400 described herein utilizes the above-described wellhead side-outlet contingency adaptor 100 to provide an innovative and quick solution in the event a VR plug profile 62 of a wellhead component becomes damaged.

Figure 5A:
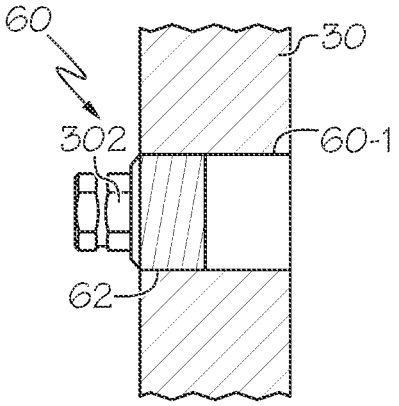
FIG. 5A-5D illustrate various phases of a method of adapting a wellhead side-outlet of a wellhead component to accommodate the installation of a valve removal (VR) plug, utilizing the wellhead side-outlet contingency, according to one or more embodiments of the present disclosure.

A first step 410 of method 400 comprises providing an apparatus configured as a contingency adaptor 100 for a wellhead side-outlet 60, wherein the apparatus comprises: (i) an outer side 102 comprising a first flange 110 and an adaptor VR plug profile 114 configured to accommodate the installation of a VR plug 302; (ii) an inner side 104 opposite the outer side 102 and comprising a second flange 120 and a neck 124; and (iii) a test port 128 to confirm the integrity of the fluid seal(s) created at the connection between the adaptor 100, the wellhead spool 60, the seal 125, and the gasket 122-1. FIG. 5A shows an exemplary wellhead side-outlet of a casing head spool 30 with a VR plug 302 installed via a VR plug profile 62 on an inner surface 60-1 of the wellhead side-outlet 60.

Figure 5B:
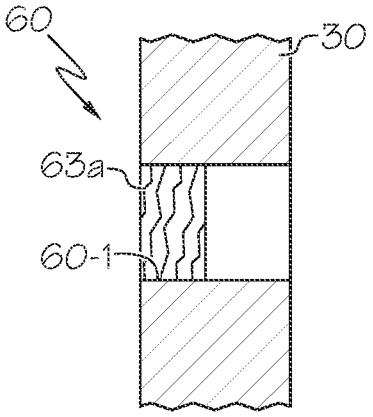

If the VR plug profile 62 of the wellhead side-outlet 60 becomes damaged, e.g., as a result of attempting to clean out hard cement stuck inside side-outlet gate valves, the connection between the VR plug 302 and the wellhead side-outlet 60 may begin to leak. Repairing the damaged VR plug profile may require a high risk operation with significant costs and downtime. FIG. 5A shows a wellhead side-outlet 60 with a VR plug 302 installed. FIG. 5B shows a wellhead side-outlet 60 with the VR plug 302 removed wherein a damaged VR plug profile 63*a* is revealed.

A second step 420 of method 400 comprises coupling the adaptor 100 to the wellhead side-outlet.

Figure 5C:
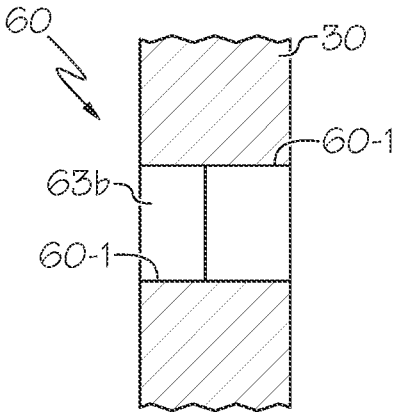
Figure 7:
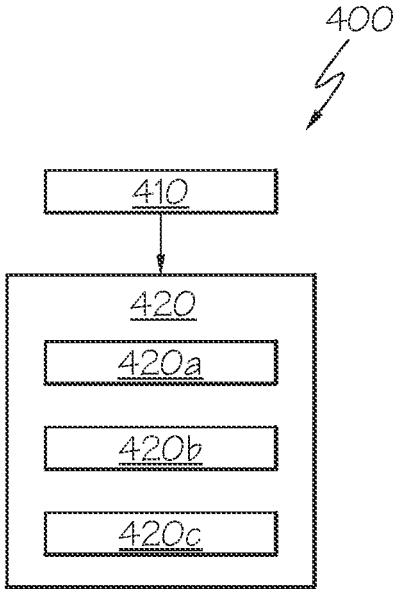
FIG. 7 illustrates a flowchart of the methodology of adapting a wellhead side-outlet of a wellhead component to accommodate the installation of a valve removal (VR) plug, utilizing the wellhead side-outlet contingency, according to one or more embodiments of the present disclosure.

While not shown in FIG. 7, prior to coupling the adaptor 100 to the wellhead side-outlet an optional intermediate step comprises polishing the damaged VR plug profile 63*a* to provide a sealing surface and ensure a proper fluid seal can be created between an outer surface 124-2 of the neck 124 and the inner surface 60-1 of the wellhead side-outlet 60. In one example, the polishing is accomplished manually by using sand paper or by utilizing an air-powered polish machine such as a pneumatic flapper wheel. FIG. 5C shows a wellhead side-outlet 60 with a polished VR plug profile 63*b* on the inner surface 60-1 of a wellhead side-outlet 60.

Figure 5D:
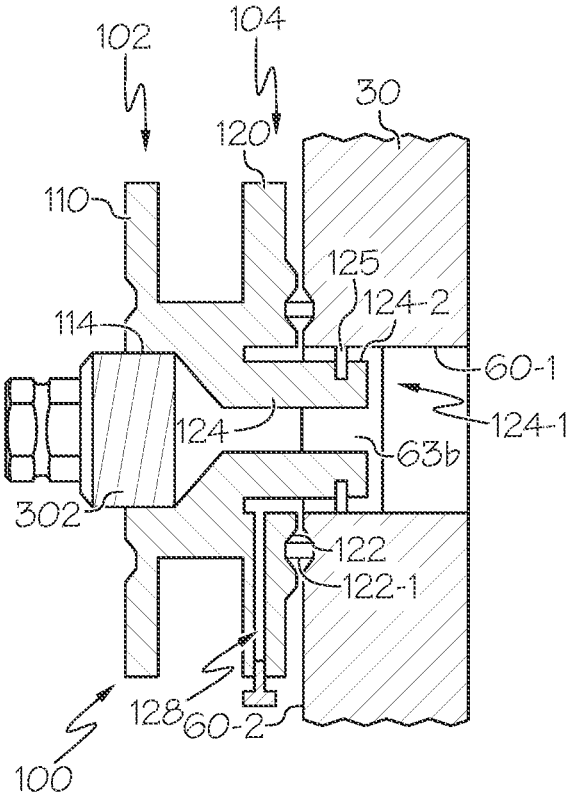

Continuing on with method 400, FIG. 5D shows the wellhead side-outlet 60 after the adaptor 100 has been coupled thereto. As shown in FIG. 7, the second step 420 of coupling the adaptor 100 to the wellhead side-outlet 60 may comprise three sub-steps: sub-step 420*a*, positioning the neck 124 within the wellhead side-outlet such that an outer surface 124-2 of the neck 124 faces an inner surface 60-1 of the wellhead side-outlet 60; sub-step 420*b*, creating, with a gasket 122-1, a first fluid seal between the second flange 120 and an outer surface 60-2 of the wellhead side-outlet 60; and sub-step 420*c*, creating, with a seal 125 placed around an outer diameter of a distal end 124-1 of the neck 124, a second fluid seal between the outer surface 124-2 of the neck 124 and the inner surface 60-1 of the wellhead side-outlet 60.

The gasket 122-1 used to create the first fluid seal may be a ring gasket and the second flange 120 may comprise a ring groove 122 for receiving the ring gasket 122-1 and creating the first fluid seal. The seal 125 used to create the second fluid seal may comprise an elastomeric material, as discussed above.

The second flange 120 may comprise a plurality of openings 123 for receiving a plurality of fasteners 123-1 for coupling the apparatus 100 to the wellhead side-outlet 60 (see e.g., FIG. 4).

The wellhead component containing the wellhead side-outlet to which the adaptor is coupled may be a casing head housing, a casing head spool, or a tubing head adaptor, as non-limiting examples.

Figure 6:
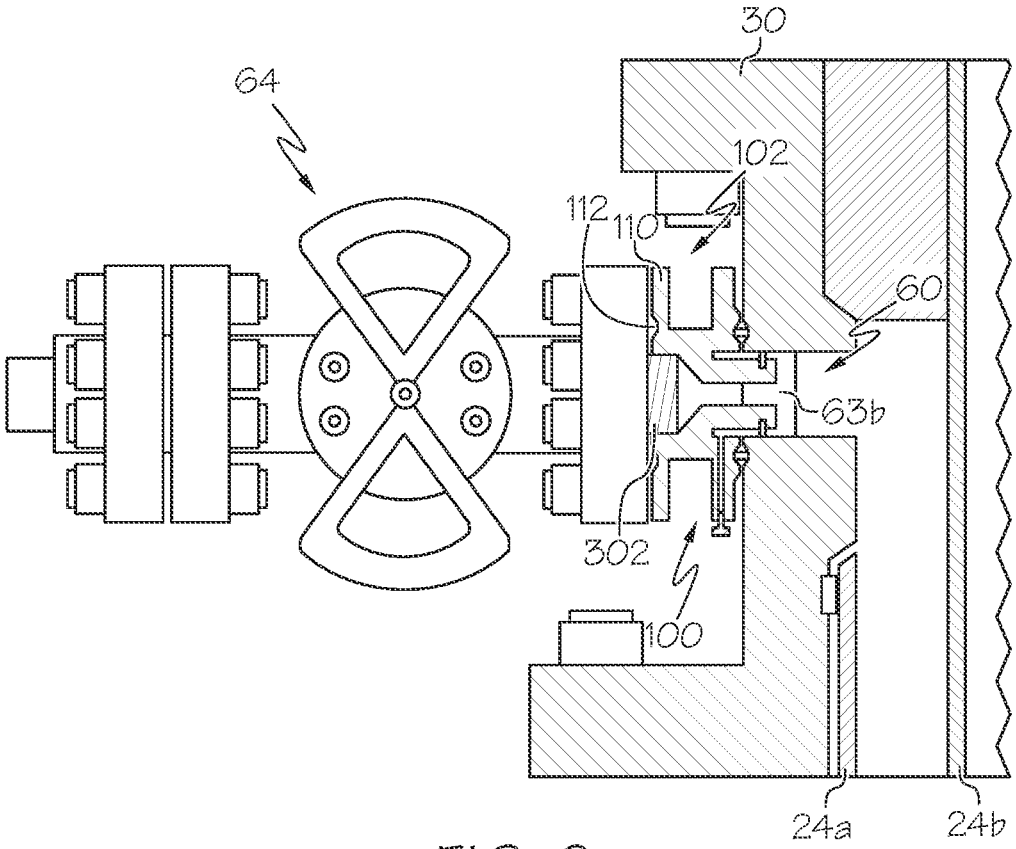
FIG. 6 illustrates a wellhead side-outlet contingency adaptor, according to one or more embodiments of the present disclosure, coupled to a wellhead side-outlet of a wellhead component on an inner (right) side, and coupled to another wellhead component on an outer (left) side.

Moreover, the method 400 may further comprise coupling the first flange 110 of the adaptor 100 to another wellhead side-outlet component, e.g., a gate valve 64. The adaptor VR plug profile 114 may comprise a machine threaded surface which may be defined by the American Petroleum Institute (API) SPEC 6A standard. FIG. 6 shows the wellhead side-outlet 60 with the adaptor 100 coupled thereto, wherein a VR plug 302 has been installed at the outer side 102 of the adaptor 100 and a gate valve 64 has been coupled to the first flange 110 of the adaptor 100.

The method 400 may optionally comprise creating, with at least one additional seal (not shown), at least one additional second fluid seal between the outer surface 124-2 of the neck 124 and the inner surface 60-1 of the wellhead side-outlet 60.

While not shown in FIG. 7, the method 400 may further comprise utilizing a test port 128 of the apparatus for conducting pressure testing of the volume 140 defined by the adaptor 100, the wellhead component comprising the wellhead side-outlet 60 to which the adaptor 100 is coupled, the seal 125 between the neck 124 and the inner surface 60-1 of the wellhead side outlet, and the gasket 122-1 between the second flange 120 and the outer surface 60-2 of the wellhead side-outlet 60.

The contingency adaptor and method of use described herein offers several advantages. It provides for a simple installation method as the adaptor may be installed on a wellhead component through a standard API flange make-up process. The integrated neck is positioned within the wellhead side-outlet so as to minimize potential leak paths. It allow for the restoring of the VR plug functionality as a mechanical barrier without resorting to critical and high-risk machining processes to repair the damaged profile. The apparatus may be inspected and tested at a manufacturing facility rather thereby avoiding the need to conduct quality control inspection on the repaired profile in the field. Finally, widely available technology, e.g., API adaptors and elastomeric seals may be used rather than specialized solutions or services.

For the purposes of describing and defining the present invention, it is noted that recitations herein of "at least one" component, element, etc., should not be used to create an inference that the alternative use of the articles "a" or "an" should be limited to a single component, element, etc. For example, reference to "a" component includes aspects having two or more such components, unless the context clearly indicates otherwise.

It is also noted that recitations herein of a component of the present disclosure being "configured" in a particular way, to embody a particular property, or to function in a particular manner, are structural recitations, as opposed to recitations of intended use. More specifically, the references herein to the manner in which a component is "configured" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that the drawings that accompany the present disclosure have not been created to scale. The absolute and relative size of the various features will depend on the material properties of the adaptor and the conditions in which the adaptor is intended to be used. For example, the size of the wellhead side-outlet as well as the pressure of an associated annulus may determine the structural characteristics of the adaptor, such as the thickness of the body portion wall, inner flange, and outer flange.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

Unless otherwise expressly stated, it is in no way intended that any method set forth herein be construed as requiring that its steps be performed in a specific order, nor that with any apparatus specific orientations be required. Accordingly, where a method claim does not actually recite an order to be followed by its steps, or that any apparatus claim does not actually recite an order or orientation to individual components, or it is not otherwise specifically stated in the claims or description that the steps are to be limited to a specific order, or that a specific order or orientation to components of an apparatus is not recited, it is in no way intended that an order or orientation be inferred, in any respect. This holds for any possible non-express basis for interpretation, including: matters of logic with respect to arrangement of steps, operational flow, order of components, or orientation of components; plain meaning derived from grammatical organization or punctuation, and; the number or type of embodiments described in the specification.

Directional terms as used herein—for example up, down, right, left, front, back, top, bottom—are made only with reference to the figures as drawn and are not intended to imply absolute orientation.

What is claimed is:

1. An apparatus configured as a contingency adaptor for a wellhead side-outlet of a wellhead component, the apparatus comprising:

an outer side comprising an first flange and a valve removal (VR) plug profile configured to accommodate installation of a VR plug;

an inner side opposite the outer side, the inner side comprising a second flange and a neck; and a test port;

wherein the second flange is configured to be coupled to the wellhead side-outlet and to receive a gasket for creating a first fluid seal between the second flange and an outer surface of the wellhead side-outlet;

wherein the neck is configured to receive a seal around an outer diameter of the neck for creating a second fluid seal between an outer surface of the neck and an inner surface of the wellhead side-outlet; and wherein the test port is configured to accommodate pressure testing a volume defined by the apparatus, the wellhead component, the seal, and the gasket.

2. The apparatus of claim 1, wherein the apparatus comprises a single, unitary structure.

3. The apparatus of claim 1, wherein the gasket is a ring gasket and the second flange comprises a ring groove for receiving the ring gasket.

4. The apparatus of claim 1, wherein the seal comprises an elastomeric material.

5. The apparatus of claim 1, wherein the second flange comprises a plurality of openings for receiving a plurality of fasteners for coupling the second flange to the wellhead side-outlet.

6. The apparatus of claim 1, wherein the wellhead component is a casing head housing, a casing head spool, or tubing head adaptor.

7. The apparatus of claim 1, wherein the neck is further configured to receive at least one additional seal around the outer diameter of the neck for creating at least one additional second fluid seal between the outer surface of the neck and the inner surface of the wellhead side-outlet.

8. The apparatus of claim 1, wherein the VR plug profile comprises a machine threaded interior surface.

9. The apparatus of claim 1, wherein the first flange is configured to be coupled to another wellhead side-outlet component.

10. The apparatus of claim 1, wherein the neck extends beyond the second flange.

11. A method of adapting a wellhead side-outlet of a wellhead component to accommodate the installation of a valve removal (VR) plug, the method comprising:

providing an apparatus configured as a contingency adaptor for the wellhead side-outlet, wherein the apparatus comprises:

an outer side comprising a first flange and a VR plug profile configured to accommodate installation of the VR plug;

an inner side opposite the outer side, the inner side comprising a second flange and a neck; and a test port;

coupling the apparatus to the wellhead side-outlet, wherein coupling the apparatus to the wellhead side-outlet comprises:

positioning the neck within the wellhead side-outlet such that an outer surface of the neck faces an inner surface of the wellhead side-outlet;

creating, with a gasket, a first fluid seal between the second flange and an outer surface of the wellhead side-outlet; and creating, with a seal placed around an outer diameter of the neck, a second fluid seal between the outer surface of the neck and the inner surface of the wellhead side-outlet; and pressure testing, via the test port, a volume defined by the apparatus, the wellhead component, the seal, and the gasket.

12. The method of claim 11, further comprising, prior to coupling the apparatus to the wellhead side-outlet, polishing a damaged valve removal profile of the wellhead side-outlet to provide a sealing surface.

13. The method of claim 11, wherein the gasket is a ring gasket and the second flange comprises a ring groove for receiving the ring gasket and creating the first fluid seal.

14. The method of claim 11, wherein the seal comprises an elastomeric material.

15. The method of claim 11, wherein the second flange comprises a plurality of openings for receiving a plurality of fasteners for coupling the apparatus to the wellhead side-outlet.

16. The method of claim 11, wherein the wellhead component is a casing head housing, a casing head spool, or tubing head adaptor.

17. The method of claim 11, further comprising creating, with at least one additional seal, at least one additional second fluid seal between the outer surface of the neck and the inner surface of the wellhead side-outlet.

18. The method of claim 11, wherein the VR plug profile comprises a machine threaded interior surface.

19. The method of claim 11, further comprising coupling the first flange to another wellhead side-outlet component.

20. The method of claim 11, wherein coupling the apparatus to the wellhead side-outlet further comprises coupling the second flange to the wellhead side-outlet following a standard API flange make-up process.

* * * * *